US009976334B2

(12) United States Patent
Monts De Oca et al.

(10) Patent No.: US 9,976,334 B2
(45) Date of Patent: May 22, 2018

(54) MIDDLE STRIP OF A DOOR FRAME

(71) Applicant: USA WORLDWIDE DOOR COMPONENTS (PINGHU) CO. LTD., Zhejiang (CN)

(72) Inventors: Jerry Lee Monts De Oca, Zhejiang (CN); Gang Zhou, Zhejiang (CN)

(73) Assignee: USA WORLDWIDE DOOR COMPONENTS (PINGHU) CO., LTD., Zhejiang (CN)

( * ) Notice: Subject to any disclaimer, the term of this patent is extended or adjusted under 35 U.S.C. 154(b) by 0 days. days.

(21) Appl. No.: 15/228,497

(22) Filed: Aug. 4, 2016

(65) Prior Publication Data

US 2017/0130514 A1 May 11, 2017

(30) Foreign Application Priority Data

Nov. 6, 2015 (CN) ..... 2015 1 0750669

(51) Int. Cl.
*E06B 1/04* (2006.01)
*E06B 3/26* (2006.01)

(52) U.S. Cl.
CPC ..... *E06B 3/26* (2013.01)

(58) Field of Classification Search
CPC ..... E06B 3/26
USPC ..... 52/204.11, 309.9, 309.11
See application file for complete search history.

(56) References Cited

U.S. PATENT DOCUMENTS 3,012,642 A * 12/1961 Emmerich ..... E06B 3/26 49/392
3,072,229 A * 1/1963 Pasche ..... E06B 3/26 49/401
3,885,351 A * 5/1975 Imperial ..... E06B 7/2316 49/470

(Continued)

FOREIGN PATENT DOCUMENTS

CN 2038144 U 5/1989
CN 2380664 Y 5/2000

(Continued)

*Primary Examiner* — Basil S Katcheves
(74) *Attorney, Agent, or Firm* — Shumaker, Loop & Kendrick, LLP; Jeffrey B. Fabian

(57) ABSTRACT

The present utility model relates to a middle strip of a door frame, which can effectively solve the problem of insufficient strength existed in the middle strip of the door frame of the prior art. A middle strip of a door frame comprises a middle strip body, wherein a positioning hole is disposed in the middle strip main body along the length direction of the middle strip body, and the positioning hole is provided with a support frame in order to enhance the strength of the middle strip body, and the support frame is arranged along the inner wall of the positioning hole. The present utility model has the following advantages: a positioning hole is disposed in the middle strip body along the length direction, and the positioning hole is provided with a support frame, therefore, he strength of the whole middle strip body is effectively improved via the support frame without changing the size and the shape of the original middle strip body, so that the middle strip body will not deform easily during the using process and has a sufficient strength.

5 Claims, 2 Drawing Sheets

(56) References Cited

U.S. PATENT DOCUMENTS 3,949,526 A * 4/1976 Sherlock ..... E06B 3/221 49/501
4,831,779 A * 5/1989 Kehrli ..... E06B 1/70 49/380
5,122,398 A * 6/1992 Seiler ..... B60R 19/03 293/120
5,136,814 A * 8/1992 Headrick ..... E06B 1/70 49/468
5,325,648 A * 7/1994 Menard ..... E06B 1/70 49/471
5,449,081 A * 9/1995 Sjostedt ..... B62D 29/045 220/1.5
5,577,363 A * 11/1996 Tate ..... B29C 44/1233 52/309.11
5,806,919 A * 9/1998 Davies ..... B62D 29/002 296/187.02
6,096,403 A * 8/2000 Wycech ..... B29C 44/1228 296/146.6
6,272,809 B1 * 8/2001 Wycech ..... B29C 39/10 264/46.5
6,474,726 B1 * 11/2002 Hanakawa ..... B62D 29/002 296/187.12
6,942,910 B2 * 9/2005 Roberts ..... B29D 22/00 296/208
6,962,031 B2 * 11/2005 Clarke ..... E05D 5/023 52/309.9
8,230,652 B2 † 7/2012 An
8,480,163 B2 * 7/2013 Mori ..... B62D 21/157 29/897.2
9,038,335 B1 * 5/2015 Eck ..... E06B 3/26 52/127.8

FOREIGN PATENT DOCUMENTS

CN 1737319 A 2/2006
CN 201908543 U 7/2011
JP H 08100577 A 4/1996
JP H 10121836 A 5/1998

* cited by examiner
† cited by third party

MIDDLE STRIP OF A DOOR FRAME

TECHNICAL FIELD

The present utility model relates to a middle strip of a door frame.

BACKGROUND

The door frame middle strip is located in the middle position of the door frame, requiring certain bearing capacity. Middle strips in the prior art are made of PVC wood-plastic-foamed material with limited bearing strength, which results in bending deformation or breaking.

SUMMARY OF THE INVENTION

The objective of the present utility model is to provide a middle strip of a door frame, which can effectively solve the problem of insufficient strength existed in the middle strip of the door frame of the prior art.

To solve the above technical problem, the following technical solution is used in the present utility model: a middle strip of a door frame, comprising a middle strip body, wherein a positioning hole is disposed in the middle strip main body along the length direction of the middle strip body, and the positioning hole is provided with a support frame in order to enhance the strength of the middle strip body, and the support frame is arranged along the inner wall of the positioning hole.

Preferably, the cross-sectional shapes of the positioning hole and the middle strip body are the same, so that the middle strip of the door frame has a uniform thickness and the support frame may play a better supporting function.

Preferably, the cross section of the positioning hole is convex, and the cross section of the support frame is convex as well, both of which have the same shape with the cross-sectional of the middle strip body, therefore improving the supporting effect.

Preferably, the bottom of the support frame is communicated with the positioning hole; and the bottom position is not affected by forces so as to reduce the overall weight and facilitate the filling of the filling block.

Preferably, a filling block, which play a role of sound insulation and heat insulation is also filled in the support frame.

Preferably, the cross-section of the filling block and the support frame, are of the same shapes, which further enhancing the barrier effect.

Compared with the prior art, the present utility model has the following advantages: a positioning hole is disposed in the middle strip body along the length direction, and the positioning hole is provided with a support frame, therefore, he strength of the whole middle strip body is effectively improved via the support frame without changing the size and the shape of the original middle strip body, so that the middle strip body will not deform easily during the using process and has a sufficient strength.

DETAILED DESCRIPTION

Figure 1:
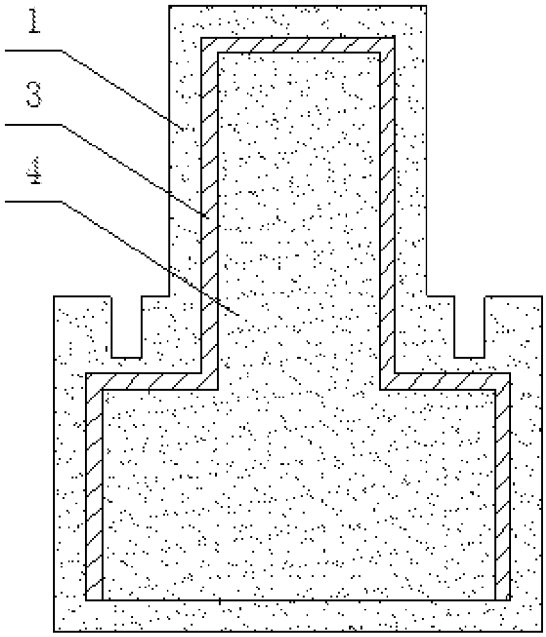
FIG. 1 shows a schematic structural diagram of the door frame middle strip in accordance with the present utility model.
Figure 2:
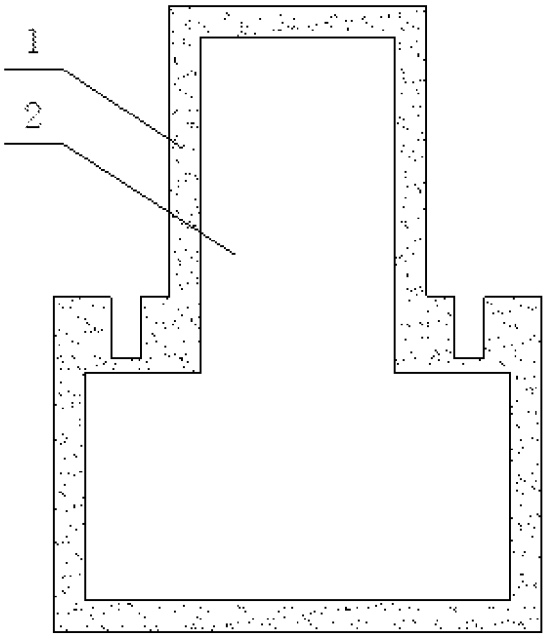
FIG. 2 shows a schematic structural diagram of the middle strip main body in the door frame middle strip in accordance with the present utility model.

As shown in the FIGS. 1 and 2, embodiments of a middle strip of a door frame in accordance with the present utility model is provided. A middle strip of a door frame, comprises an middle strip body 1, wherein the cross section of the middle strip body 1 is convex, and a positioning hole 2 is disposed in the middle strip body 1 along the length direction of the middle strip body 1. The cross section of the positioning hole 2 is convex, and the positioning hole 2 is provided with a support frame 3 in order to enhance the strength of the middle strip body 1. The cross section of the support frame 3 is convex as well, and the support frame 3 is made of lightweight materials such as aluminium alloy. The support frame 3 is arranged along the inner wall of the positioning hole 2, and the support frame 3 is filled with a filling block 4, the cross-section of which has the same shape as that of the support frame 3.

In order to facilitate the filling of the filling block 4, the bottom of the support frame 3 has an open structure so as to communicate directly with the positioning hole 2. The filling block 4 has the same material as that of the middle strip body 1, both of which can be made of PVC wood-plastic-foamed material.

First, the middle strip body 1 with the positioning hole 2 is manufactured, then the shaped support frame 3 is filled into the positioning hole 2, and finally, the filling block 4 is filled into the support frame 3 to complete the assembly. The positioning hole 2 is disposed in the middle strip body 1 along the length direction, and the positioning hole 2 is provided with a support frame 3. The strength of the whole middle strip main body 1 is effectively improved via the support frame 3 without changing the size and the shape of the original middle strip body 1, so that the middle strip main body 1 will not deform easily during the using process and has sufficient strength.

The descriptions mentioned above are only specific embodiments of the present utility model, but the technical feature of the present utility model is not limited the specific embodiments. Any changes or modifications made in the field of the present utility model by any people skilled in the art should be contained within the patent scope of the present utility model.

The invention claimed is:

1. A middle strip of a door frame comprising:

(a) an elongated middle strip body having a first axis extending between a first end and an open end and a second axis transverse to the first axis, wherein the middle strip body comprises (i) a positioning cavity defining an interior surface of the middle strip body and extending along a first length of the first axis;

(ii) a bottom portion having a cross section that defines (A) a first side and a second side opposite the first side, (B) a third side that extends between the first side and the second side, (C) a first rabbet adjacent to the first side, and (D) a second rabbet adjacent to the second side;

(iii) a convex portion formed between the first rabbet and the second rabbet, wherein the convex portion comprises (A) a first face and a second face extending outward from the bottom portion along the second axis, and (B) a third face extending between the first face and the second face;

(b) a support frame disposed in the positioning cavity and extending along a second length of the first axis, wherein (i) the support frame comprises (A) a first segment extending at least partially along the first side, (B) a second segment extending at least partially along the first rabbet, (C) a third segment extending at least partially along the first face, (D) a fourth segment extending at least partially along the third face, (E) a fifth segment extending at least partially along the second face, (F) a sixth segment extending at least partially along the second rabbet, and (G) a seventh segment extending at least partially along the second side, and wherein (ii) each support frame segment engages the interior surface of the middle strip body, and (c) a filling block disposed within the positioning cavity and extending along a third length of the first axis, wherein the filling block engages each segment of the support frame and engages the interior surface of the middle strip body along the third side.

2. The middle strip of a door frame of claim 1 further comprising a channel extending along a fourth length of the first axis and formed in the bottom portion first rabbet.

3. The middle strip of a door frame of claim 1, wherein the support frame is an aluminum alloy.

4. The middle strip of a door frame of claim 1, wherein the middle strip body is a PVC wood-plastic foamed material.

5. The middle strip of a door frame of claim 1, wherein the filling block is a PVC wood-plastic foamed material.

* * * * *